US006855094B1

(12) United States Patent
Maresh

(10) Patent No.: US 6,855,094 B1
(45) Date of Patent: Feb. 15, 2005

(54) EXERCISE APPARATUS WITH ELLIPTICAL FOOT MOTION

(76) Inventor: Joseph D. Maresh, P.O. Box 645, West Linn, OR (US) 97068-0645

( * ) Notice: Subject to any disclaimer, the term of this patent is extended or adjusted under 35 U.S.C. 154(b) by 0 days.

(21) Appl. No.: 10/634,136

(22) Filed: Aug. 4, 2003

Related U.S. Application Data

(63) Continuation-in-part of application No. 10/066,029, filed on Jan. 31, 2002, now Pat. No. 6,786,851, and a continuation-in-part of application No. 09/065,308, filed on Apr. 23, 1998

(60) Provisional application No. 60/489,196, filed on Jul. 21, 2003, and provisional application No. 60/044,957, filed on Apr. 26, 1997.

(51) Int. Cl.[7] ..... A63B 22/00
(52) U.S. Cl. ..... 482/52; 482/57
(58) Field of Search ..... 482/51–53, 57, 482/70, 79, 80

(56) References Cited

U.S. PATENT DOCUMENTS 5,779,599 A * 7/1998 Chen ..... 482/57
5,897,463 A * 4/1999 Maresh ..... 482/70
6,135,923 A * 10/2000 Stearns et al. ..... 482/51
6,196,948 B1 * 3/2001 Stearns et al. ..... 482/52
6,302,825 B1 * 10/2001 Stearns et al. ..... 482/52
6,387,017 B1 * 5/2002 Maresh ..... 482/57
6,450,925 B1 * 9/2002 Kuo ..... 482/52
6,461,277 B2 * 10/2002 Maresh et al. ..... 482/52
6,620,079 B2 * 9/2003 Kuo ..... 482/51

* cited by examiner

*Primary Examiner*—Stephen R. Crow

(57) ABSTRACT

An exercise apparatus includes left and right rigid connector links having first portions rotatably connected to respective cranks, second portions constrained to move in reciprocating fashion, and third portions connected to respective foot supports. Intermediate links are also interconnected between respective cranks and respective foot supports. The resulting assembly links rotation of the cranks to movement of the foot supports through generally elliptical stepping paths. The connection points may be moved relative to one another and/or a supporting frame to adjust the size, shape, and/or orientation of the paths.

3 Claims, 8 Drawing Sheets

H
- 8.4 degrees
2250
2260
2255
2200
2230
12 o'clock
2240
2210

H
- 9.1 degrees
2255
2260
F
2200
2240
2230
1 o'clock
M
C
2223
2210

H
- 4.3 degrees
2255
2260
2200
2240
2230
2 o'clock
2210
2226

2260
2200
+ 1.5 degrees
2255
2240
2230
H
3 o'clock
2210

2300
2350
2340
2330
2310
- 4.7 degrees 2300
2340
2350
2310
- 2.0 degrees
2330

2300
2350
2340
2310
0 degrees
2330

2300
2340
2350
2310
+ 0.8 degrees
2330

2310
2300
2340
2350
2350 l
0 degrees
2300
2340
2350
2310

2330
l
- 1.1 degrees
2300
2350
2340
2310

2330
l
- 2.4 degrees
2350
2355
2340
2310

2300
2329
2326
2360
l
- 2.9 degrees

EXERCISE APPARATUS WITH ELLIPTICAL FOOT MOTION

CROSS-REFERENCE TO RELATED APPLICATIONS

This application is a continuation-in-part of (1) U.S. patent application Ser. No. 10/066,029, filed on Jan. 31, 2002 now U.S. Pat. No. 6,786,851; and (2) U.S. patent application Ser. No. 09/065,308, filed on Apr. 23, 1998, turn, discloses subject matter entitled to the filing date of U.S. Provisional Application Ser. No. 60/044,957, filed on Apr. 26, 1997. Also, this application discloses subject matter entitled to the filing date of U.S. Provisional Application No. 60/489,196, filed on Jul. 21, 2003.

FIELD OF THE INVENTION

The present invention relates to exercise methods and apparatus and more particularly, to exercise equipment that facilitates a generally elliptical foot motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Still another type of exercise equipment has been designed to facilitate generally elliptical exercise motion.

A variety of elliptical motion exercise machines have been disclosed in patents, including U.S. Pat. No. 4,185,622 to Swenson, and U.S. Pat. Nos. 5,242,343 and 5,383,829 to Miller. The Miller patents are the subject of a license with Precor Incorporated, a manufacturer of fitness equipment. Precor has essentially taken the position that these Miller patents (one of which was the subject of a reexamination proceeding) cover any elliptical motion machine that generates more heel rise than toe rise as a person's foot begins moving forward on the machine. Therefore, an object of the present invention is to provide an elliptical motion exercise machine that guides a person's feet in a way that falls outside the "heel rise" language in the Miller claims.

SUMMARY OF THE INVENTION

The present invention may be described in terms of novel linkage assemblies and corresponding exercise apparatus suitable for generating generally elliptical foot motion. On each side of certain exemplary embodiments, a first portion of a connector link is rotatably connected to a crank; a second portion of the connector link is rotatably connected to a rocker link; and a third portion of the connector link is rotatably connected to a foot support. Also, an intermediate link or orientation controlling means is movably interconnected between the foot support and the crank to control the orientation of the foot support so there is not more heel rise than toe rise during the transition from rearward foot travel to forward foot travel.

On one depicted embodiment, the orientation controlling means is a floating crank link, and the foot support is pivotally connected to a distal end of the connector link. On another depicted embodiment, the orientation controlling means is a roller, and the foot support is pivotally connected to an intermediate portion of the connector link. Many features and/or advantages of the present invention may become more apparent from the more detailed description set forth below.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
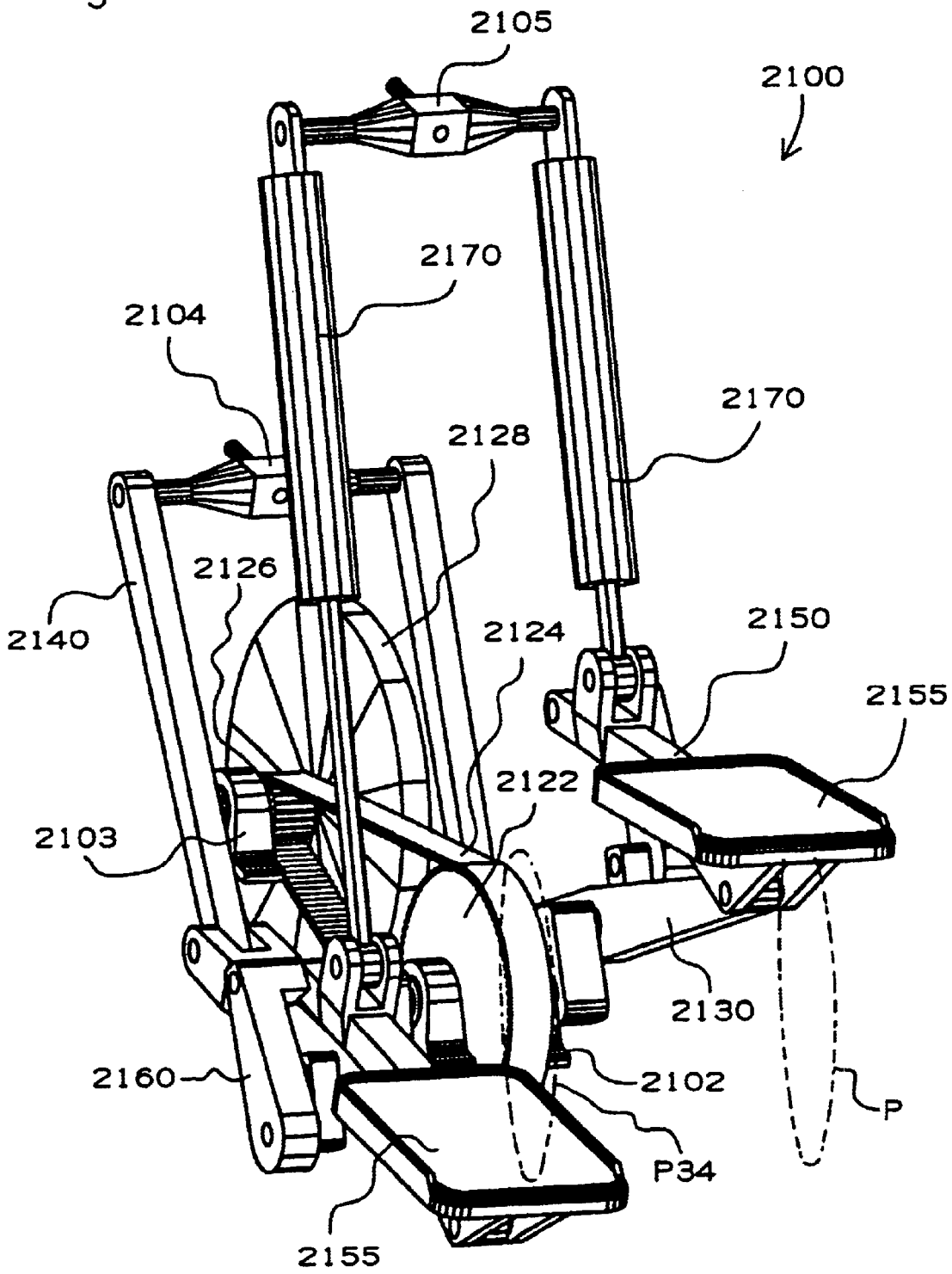
FIG. 1 is a perspective view of first exercise apparatus constructed according to the principles of the present invention.
Figure 2:
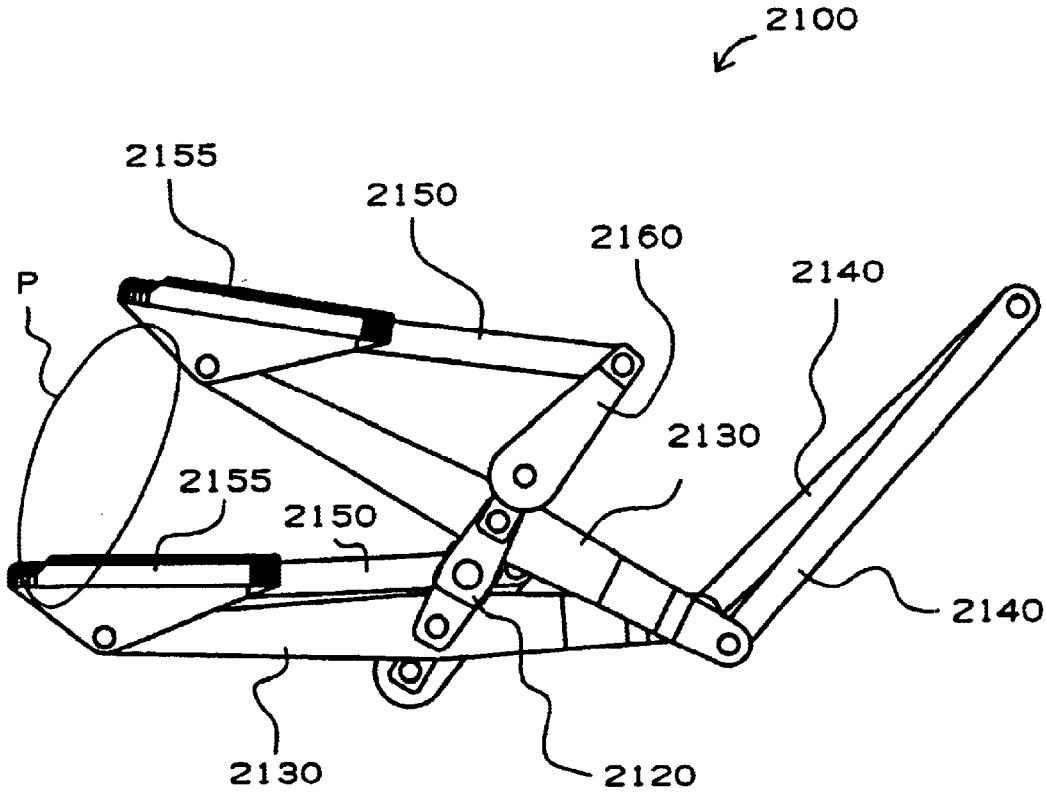
FIG. 2 is a side view of a portion of the exercise apparatus of FIG. 1.

FIGS. 1–2 show a first exercise apparatus 2100 constructed according to the principles of the present invention. The exercise apparatus 2100 includes left and right cranks 2120 rotatably connected to a frame by means of a crank shaft and bearing assemblies 2102. A larger diameter pulley 2122 is keyed to the crank shaft and rotates together with the cranks 2120 about a common crank axis. A belt 2124 connects the pulley 2122 to a smaller diameter pulley 2126 which is rigidly secured to a flywheel 2128. The pulley 2126 and the flywheel 2128 are rotatably connected to the frame by means of a flywheel shaft and bearing assemblies 2103. As a result, the pulley 2126 and the flywheel 2128 rotate at a relative faster rotational velocity than the cranks 2120 and pulley 2122. A conventional resistance device may be connected to the flywheel 2128 to resist rotation thereof.

Left and right connector links 2130 have intermediate portions which are rotatably connected to radially displaced portions of respective cranks 2120. The connector links 2130 have first ends which are rotatably connected to first ends of respective rocker links 2140, and second, opposite ends which are connected to respective foot supporting members or foot links 2150. The rocker links 2140 have second, opposite ends which are rotatably connected to the frame by means of frame member 2104.

One end of each foot supporting member 2150 is rotatably connected to a respective connector link 2130, and an opposite end of each foot supporting member 2150 is rotatably connected to an end of a respective floating crank or intermediate link 2160. An opposite end of each floating crank 2160 is rotatably connected to a distal end of a respective crank 2120. Left and right foot platforms 2155 are mounted on respective foot supporting members 2150 proximate their pivotal connections with respective connector links 2130. The floating cranks 2160 and pivoting foot supporting members 2150 cooperate to maintain the foot platforms 2155 in relatively favorable orientations throughout an exercise cycle.

Optional left and right dampers 2170 are rotatably interconnected between frame member 2105 and intermediate portions of respective foot supporting members 2150. The arrangement is such that the dampers 2170 tend to resist downward movement of the foot platforms 2155 without unduly interfering with "over center" rotation of the cranks 2120.

FIGS. 3A–3L show a second exercise apparatus 2200 which is constructed according to the principles of the present invention, and which is similar in many respects to the first exercise apparatus 2100. For ease of illustration and discussion, only one side of the exercise apparatus 2200 is shown (with the understanding that opposite side counterparts function in similar fashion, but typically one hundred and eighty degrees out of phase with the depicted parts). The side of the apparatus 2200 shown in FIGS. 3A–3L is the right side of the apparatus 2200, meaning that a user will be encouraged to mount the machine 2200 with his toes extending toward the rocker links 2240.

Figures 3A, 3B, 3C, 3D:
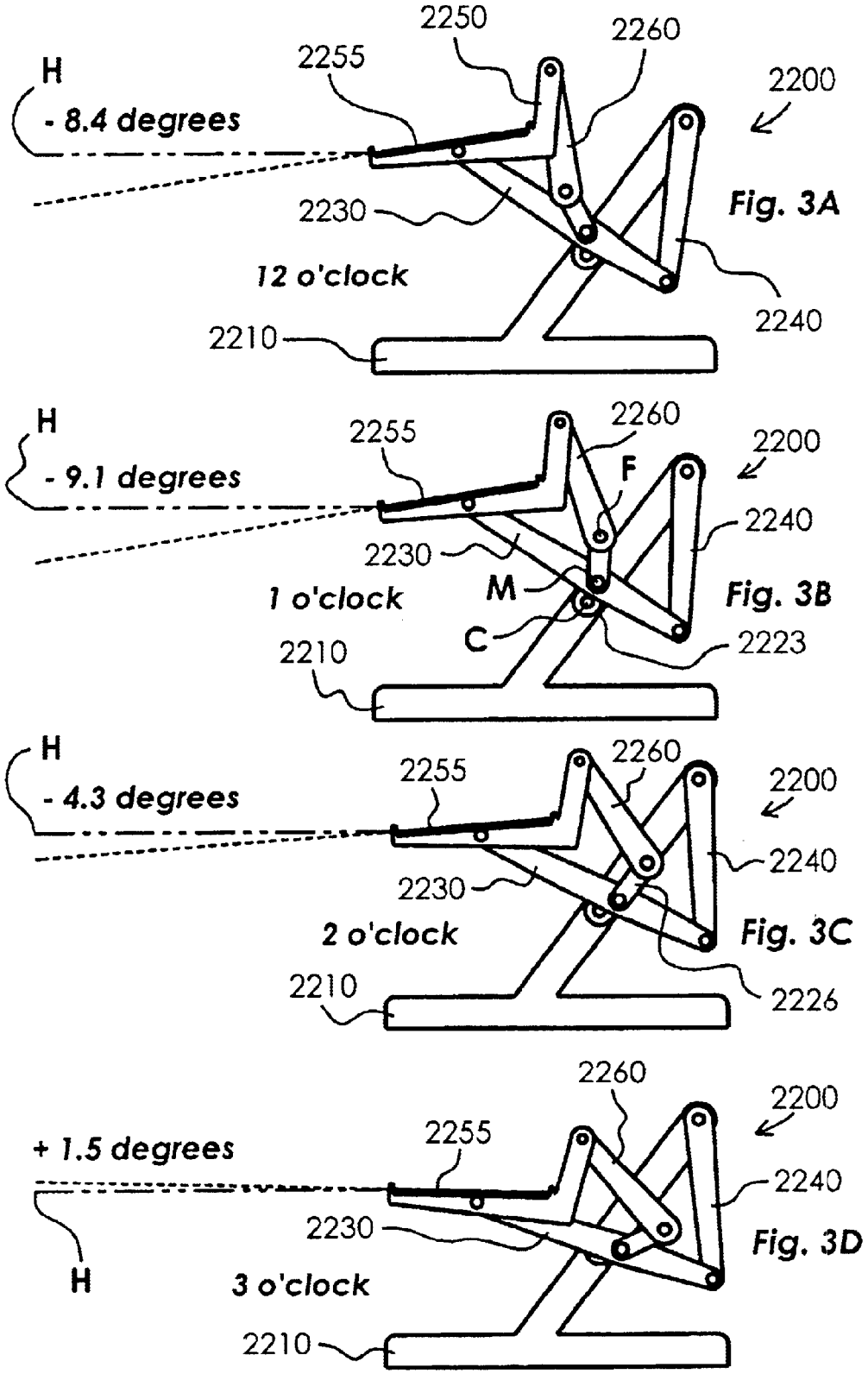
FIGS. 3A–3L are side views of a second exercise apparatus constructed according to the principles of the present invention, showing one side of the second exercise apparatus at different points during an exercise cycle.
Figure 3E:
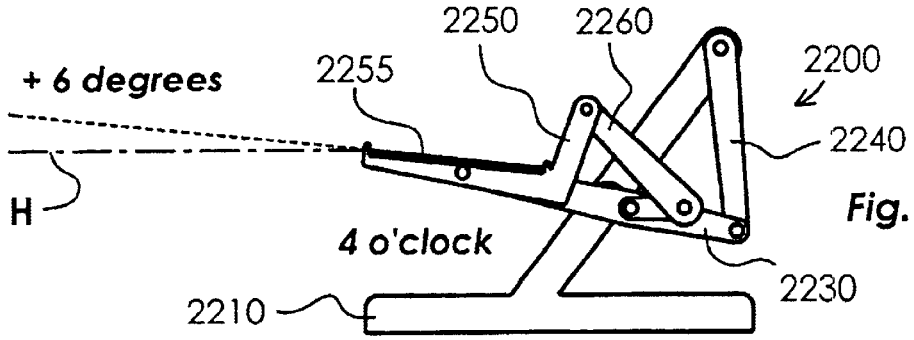
Figure 3F:
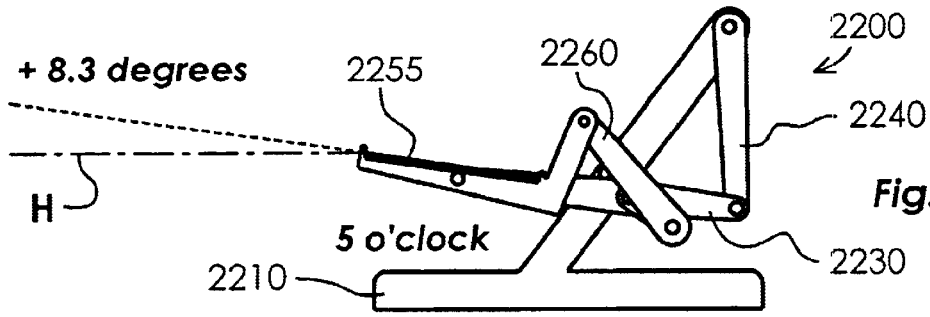
Figure 3G:
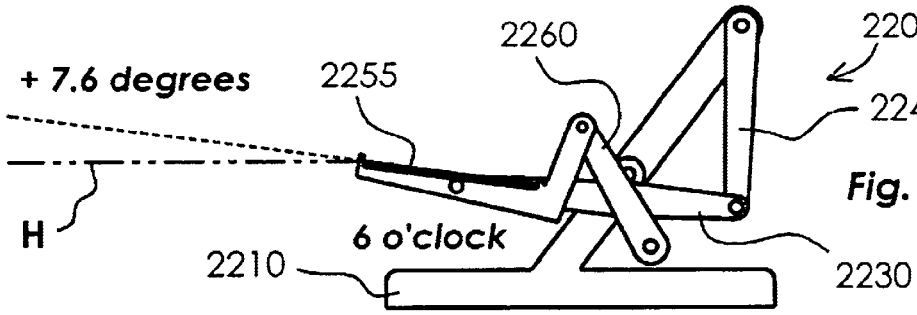
Figure 3H:
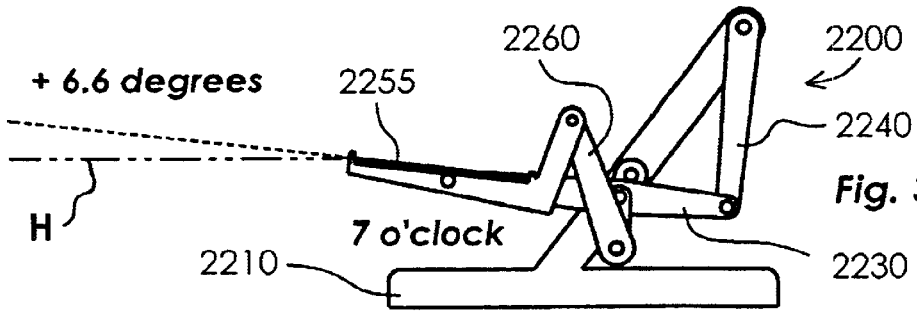
Figures 3I, 3J, 3K, 3L:
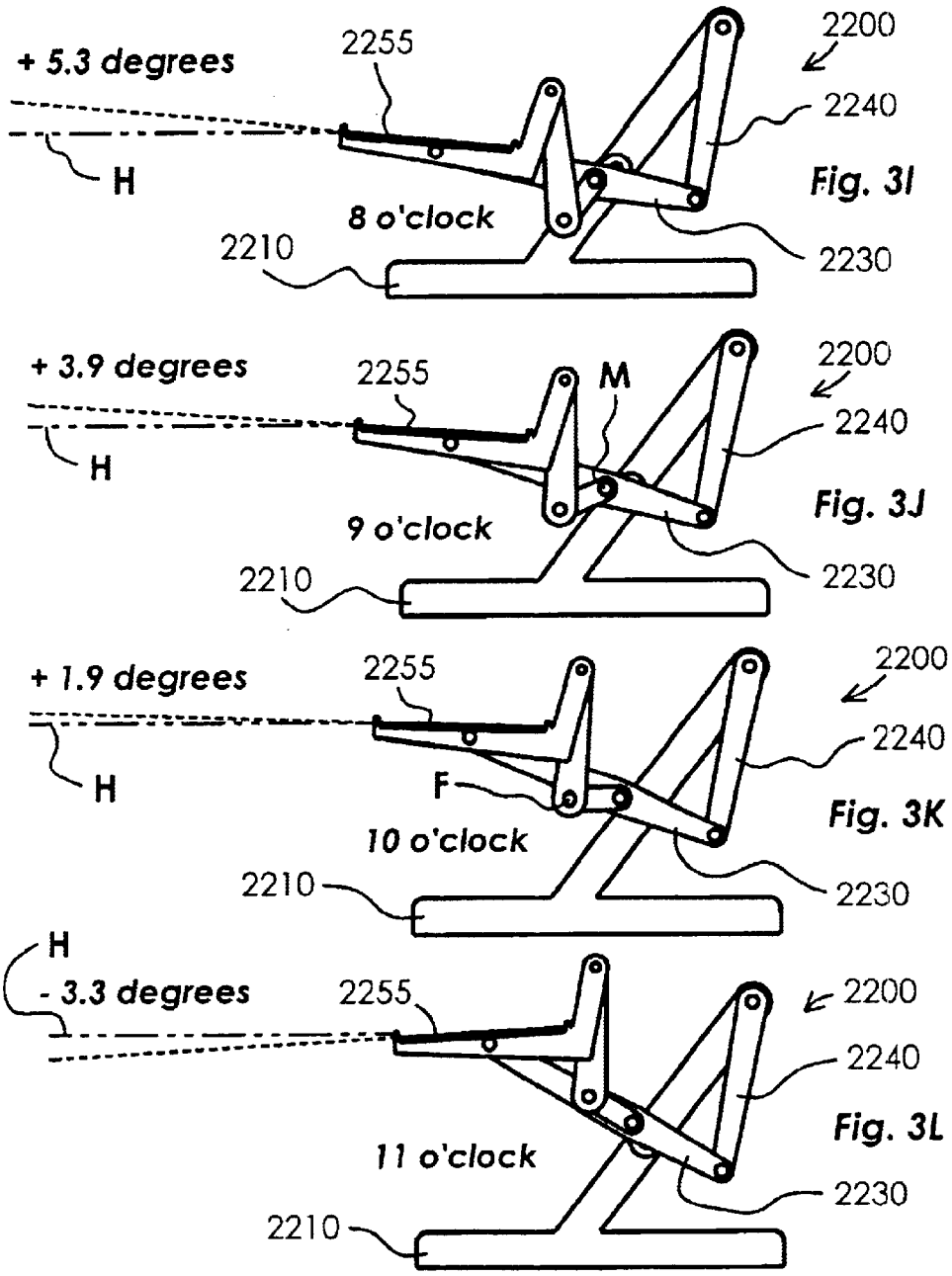
Figure 4A:
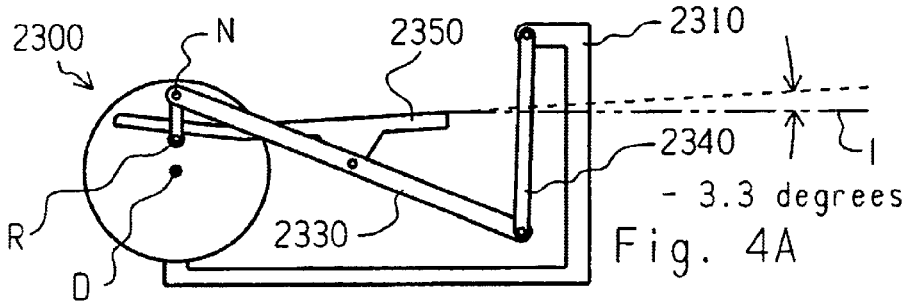
FIGS. 4A–4L are side views of a third exercise apparatus constructed according to the principles of the present invention, showing one side of the third exercise apparatus at different points during an exercise cycle.
Figure 4B:
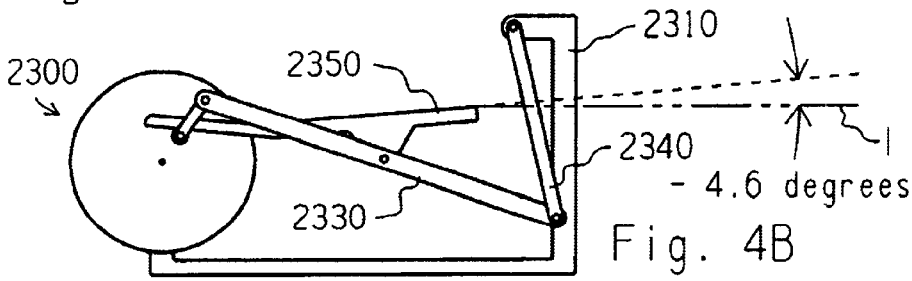
Figure 4C:
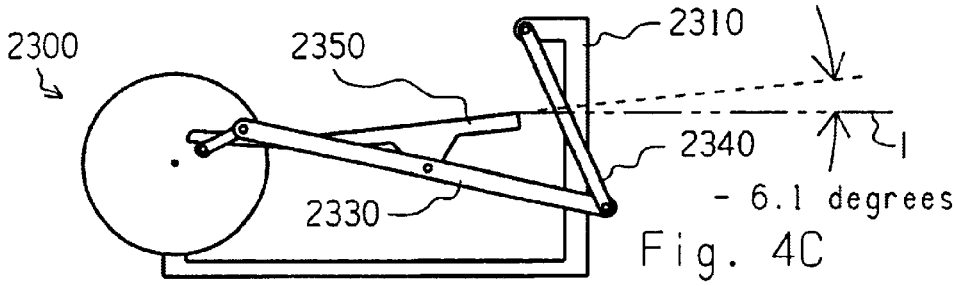
Figure 4D:
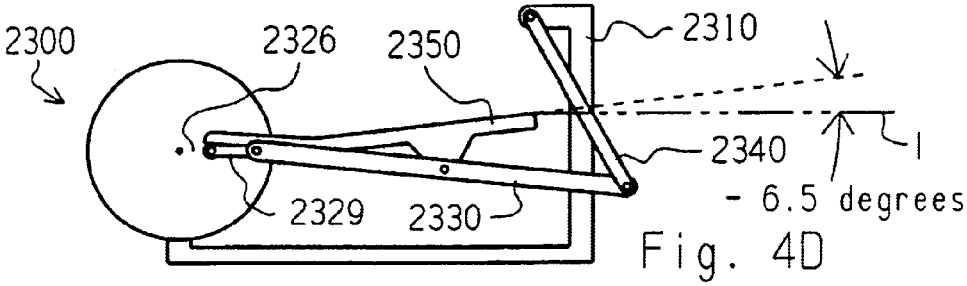
Figures 4E, 4F, 4G, 4H:
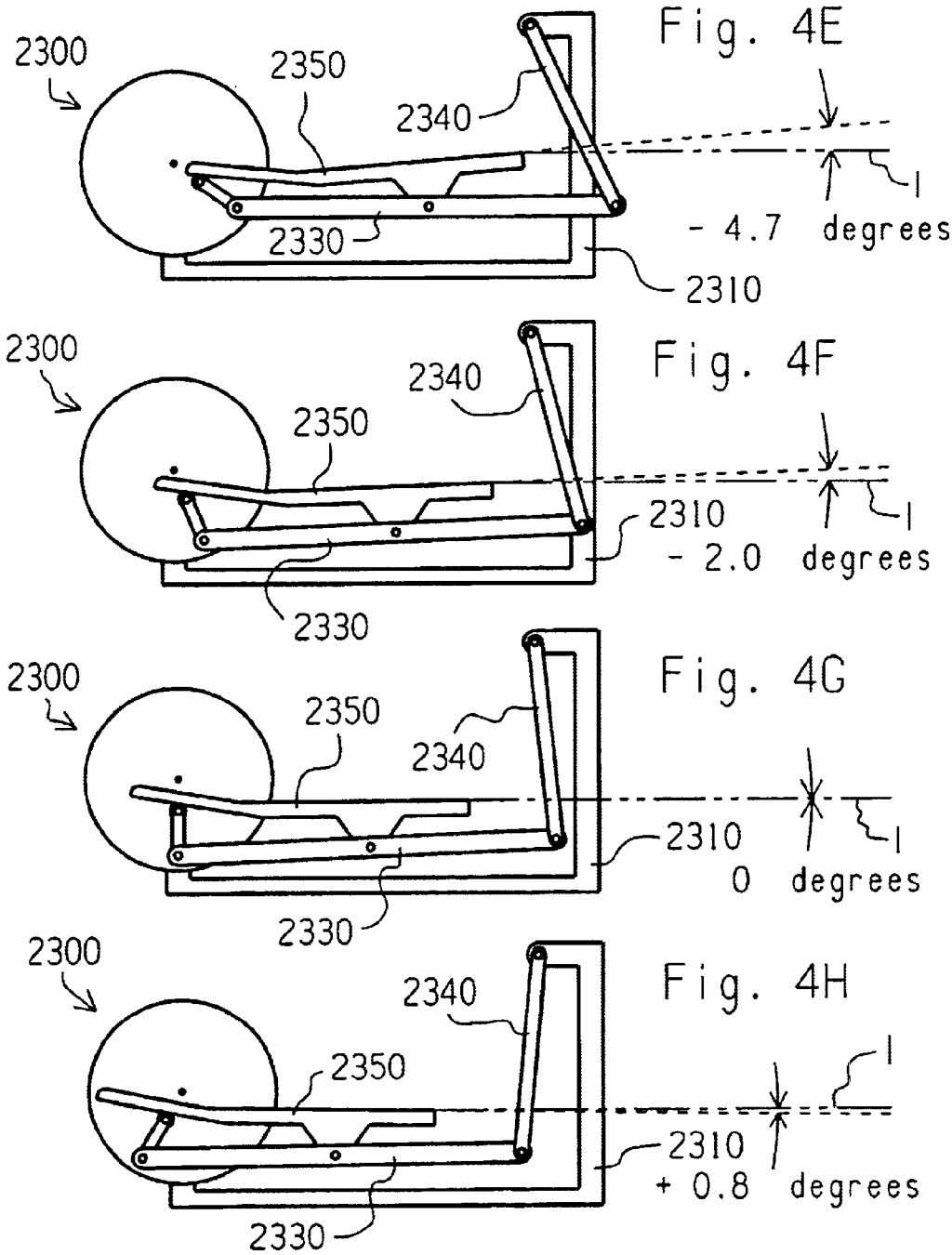
Figures 4I, 4J, 4K, 4L:
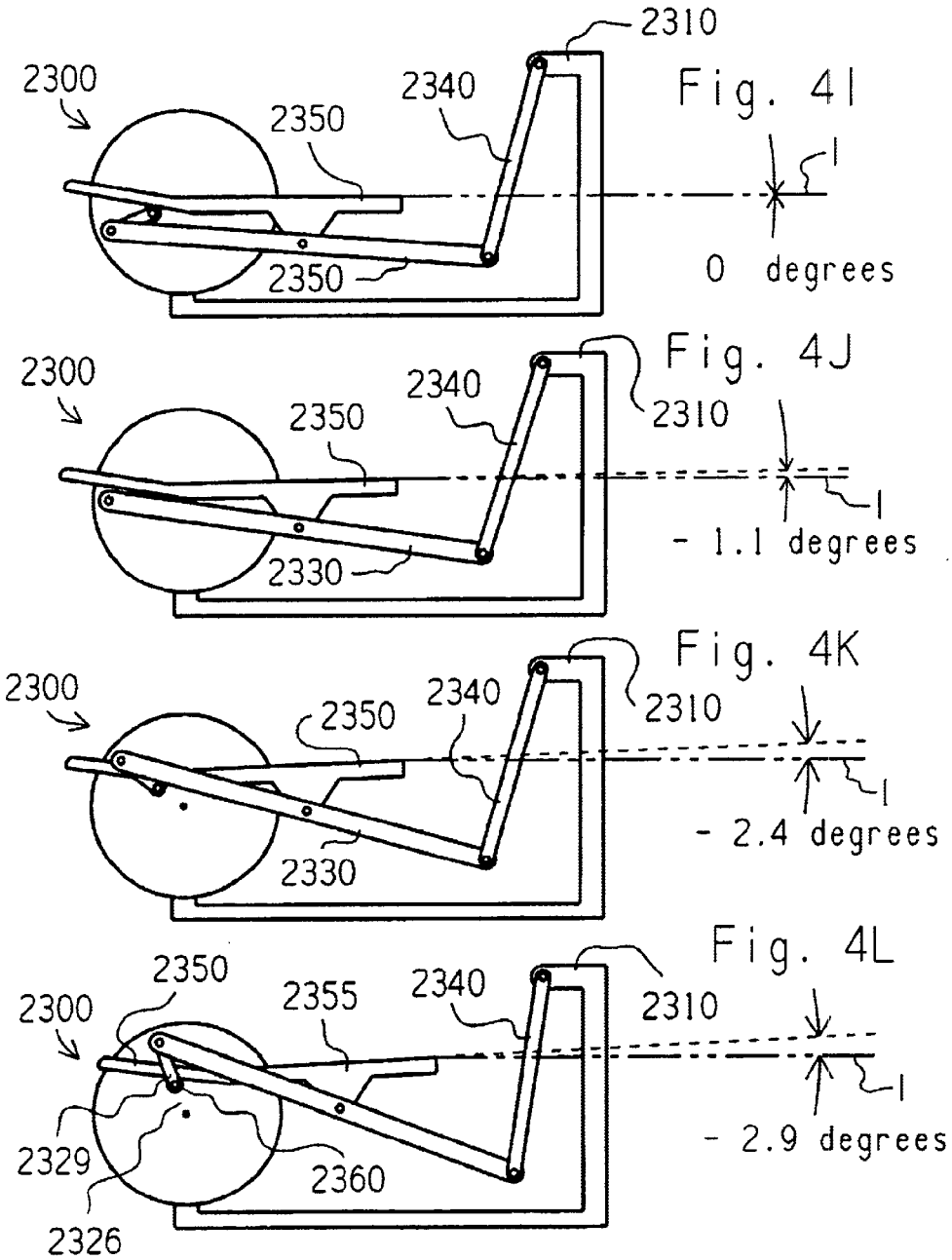

The exercise apparatus 2200 includes left and right cranks rotatably connected to a frame 2210 by means of a crank shaft and bearing assemblies. As shown in FIGS. 3B and 3C, each crank includes (1) a first crank arm 2223 having a first end rotatably connected to the frame 2210 at crank axis C, and an opposite, second end rotatably connected to a respective connector link 2230 at a respective connector link axis M; and (2) a second crank arm 2226 having a first end rotatably connected to the frame 2210 at crank axis C (via a rigid connection to the second end of the first crank segment 2223), and an opposite second end rotatably connected to a respective floating link or intermediate link 2260 at a respective floating crank axis F. Various conventional inertial devices and/or resistance devices many be connected to the cranks (directly or indirectly) by means known in the art.

The left and right connector links 2230 have intermediate portions that are rotatably connected to the distal ends of respective crank arms 2223. The connector links 2230 have first ends that are rotatably connected to first ends of respective rocker links 2240, and second, opposite ends that are rotatably connected to respective foot supporting members or foot links 2250. The rocker links 2240 have second, opposite ends that are rotatably connected to the frame 2210. Those skilled in the art will recognize that the rocker links 2240 may be described as guides that direct the first ends of the connector links 2230 through respective reciprocal paths, and that this function may alternatively be performed by rollers rotatably mounted on the first ends of the connector links 2230 and rollable along a portion of the frame 2210.

A first portion of each foot supporting member 2250 is rotatably connected to a respective connector link 2230, and a second portion of each foot supporting member 2250 is rotatably connected to an end of a respective floating crank 2260. As noted above, an opposite end of each floating crank 2260 is rotatably connected to a distal end of a respective crank arm 2226. Left and right foot platforms 2255 are provided on respective foot supporting members 2250, and are configured to support a person's respective feet.

The machine 2200 operates in the same general manner as the machine 2100 shown in FIGS. 1–2. However, the linkage assembly components on the machine 2200 are specifically configured to move the foot platforms 2255 in a manner inconsistent with the "heel rise" limitation recited in the claims of the aforementioned Miller patents. In this regard, FIGS. 3A–3L show the right side of the machine 2200 as the right crank 2220 is rotated in thirty degree intervals throughout an exercise cycle. The axis M reaches a rearwardmost, 9:00 position in FIG. 3J; the axis F reaches a rearwardmost position as the axis M rotates clockwise beyond its 10:00 orientation shown in FIG. 3K; and the right rocker link 2240 pivots to a rearwardmost position as the axis M rotates clockwise beyond the 10:00 position shown in FIG. 3K. As suggested by the reference lines and associated angular measurements (where H is horizontal or parallel to the floor, and the other dashed line is parallel to the foot supporting surface on the right foot platform 2255), the right foot platform 2255 is not experiencing faster heel rise than toe rise at any time between the 8:00 position shown in FIG. 3I and the 1:00 position shown in FIG. 3B. In other words, the heel portion of the foot platform 2255 does not rise faster than the toe portion of the foot platform 2255 as the forward end of the connector link 2230 begins moving forward from a point at a rearward end of its path.

FIGS. 4A–4L show a third exercise apparatus 2300 which is constructed according to the principles of the present invention, and which also accommodates foot motion that is inconsistent with the "heel rise" limitation recited in the claims of the aforementioned Miller patents. For ease of illustration and discussion, only one side of the exercise apparatus 2300 is shown is (with the understanding that opposite side counterparts function in similar fashion, but typically one hundred and eighty degrees out of phase with the depicted parts). The side of the apparatus 2300 shown in FIGS. 4A–4L is the right side of the apparatus 2300, meaning that a user will be encouraged to mount the machine 2300 with his toes extending toward the rocker links 2340.

The exercise apparatus 2300 includes left and right cranks rotatably connected to a frame 2310 by means of a crank shaft and bearing assemblies. The cranks rotate about a crank axis D relative to the frame 2310. Each crank includes (1) a first crank arm having a distal end that is rotatably connected to a respective connector link 2330 at a connector link axis N; and (2) a second crank arm 2326 having a distal end that rotatably supports a respective roller or intermediate link 2360 at a roller axis R. A crank extension 2329 is rigidly interconnected between the distal end of the second crank arm 2326 and the distal end of the first crank arm to prevent interference between the parts during operation of the machine 2300. Various conventional inertial devices and/or resistance devices many be connected to the cranks (directly or indirectly) by means known in the art.

The left and right connector links 2330 have rearward ends that are rotatably connected to the distal ends of respective crank extensions 2329. The connector links 2330 have opposite, forward ends that are rotatably connected to lower ends of respective rocker links 2340, and intermediate portions that are rotatably connected to respective foot supporting members or foot links 2350. The rocker links 2340 have opposite, upper ends that are rotatably connected to the frame 2310. Those skilled in the art will recognize that the rocker links 2340 may be described as guides that direct the first ends of the connector links 2330 through respective reciprocal paths, and that this function may alternatively be performed by rollers rotatably mounted on the first ends of the connector links 2330 and rollable along a portion of the frame 2310. Those skilled in the art will also recognize that the rocker links 2340 may be extended upward beyond their pivot axis, in which case, the upper distal ends of the extended rocker links may be configured for use as handlebars to facilitate upper body exercise together with the lower body exercise.

A forward portion of each foot supporting member 2350 is rotatably connected to the intermediate portion of a respective connector link 2330, and a rearward portion of each foot supporting member 2250 is rotatably supported on a respective roller 2360. As noted above, each roller 2360 is mounted on a respective crank at the distal end of a respective crank arm 2326. Low friction bearing surfaces and/or telescoping assemblies may be substituted for the rollers 2360 without departing from the scope of the present invention. In any event, each foot supporting member 2350 is provided with a foot platform 2355 to support a person's foot.

FIGS. 4A–4L show the right side of the machine 2300 as the right crank 2320 is rotated in thirty degree intervals throughout an exercise cycle. The axes N and R reach a rearwardmost, 9:00 position, in FIG. 4J; and the right rocker link 2340 pivots to a rearwardmost position as the axes N and R rotate from the 9:00 position in FIG. 4J to the 10:00 position in FIG. 4K. As suggested by the reference lines and associated angular measurements (where I is horizontal or parallel to the floor, and the other dashed line is parallel to the foot supporting surface on the right foot platform 2355), the right foot platform 2355 is not experiencing faster heel rise than toe rise at any time between the 7:00 position shown in FIG. 4H and the 3:00 position shown in FIG. 4D. In other words, the heel portion of the foot platform 2355 does not rise faster than the toe portion of the foot platform 2355 as the forward end of the connector link 2330 begins moving forward from a point at a rearward end of its path.

The foregoing disclosure is directed toward specific embodiments and a particular application with the understanding that persons skilled in the art will be able to derive additional embodiments, modifications, and/or features that nonetheless fall within the scope of the present invention. Therefore, the scope of the present invention is to be limited only to the extent of the claims which follow.

What is claimed is:

1. An exercise apparatus, comprising:

a frame designed to rest upon a floor surface;

a left crank and a right crank, wherein each said crank is rotatably mounted on the frame;

a left guide and a right guide, wherein each said guide is mounted on the frame for movement in oscillatory fashion relative thereto;

a left connector link and a right connector link, wherein each said connector link has a first portion movably connected to a respective said crank and a second portion movably connected to a respective said guide;

a left foot supporting link and a right foot supporting link, wherein each said foot supporting link is operatively connected to a respective said connector link;

a left intermediate link interconnected between the left crank and the left foot supporting link in such a manner that a heel portion of the left foot supporting link does not initially rise at a faster rate than an opposite, toe portion of the left foot supporting link as the left foot supporting link begins moving forward from a rearwardmost position relative to the frame; and a right intermediate link interconnected between the right crank and the right foot supporting link in such a manner that a heel portion of the right foot supporting link does not initially rise at a faster rate than an opposite, toe portion of the right foot supporting link as the right foot supporting link begins moving forward from a rearwardmost position relative to the frame.

2. The exercise apparatus of claim 1, wherein each said intermediate link is a floating crank link.

3. The exercise apparatus of claim 1, wherein each said intermediate link is a roller.

* * * * *